US007698925B2

(12) United States Patent
Dodge

(10) Patent No.: US 7,698,925 B2
(45) Date of Patent: Apr. 20, 2010

(54) CRIMPER DEVICE

(75) Inventor: Robert B. Dodge, 13 Cambridge Blvd., Pleasant Ridge, MI (US) 48069

(73) Assignee: Robert B. Dodge, Pleasant Ridge, MI (US)

( * ) Notice: Subject to any disclaimer, the term of this patent is extended or adjusted under 35 U.S.C. 154(b) by 316 days.

(21) Appl. No.: 11/880,491

(22) Filed: Jul. 23, 2007

(65) Prior Publication Data

US 2009/0025451 A1 Jan. 29, 2009

(51) Int. Cl.
*B25B 7/02* (2006.01)
*B25B 7/20* (2006.01)

(52) U.S. Cl. ..... 72/409.19; 72/409.01; 72/409.13

(58) Field of Classification Search ..... 72/412, 72/416, 453.16, 476, 479, 409.01, 409.08, 72/409.11, 409.13, 409.19, 409.16; 81/419, 81/420

See application file for complete search history.

(56) References Cited

U.S. PATENT DOCUMENTS 3,422,521 A * 1/1969 Beinhaur ..... 29/764

6,050,123 A * 4/2000 Fies ..... 72/326

OTHER PUBLICATIONS

U.S. Appl. No. 11/654,958, filed Jan. 18, 2007, Opperhauser.

* cited by examiner

*Primary Examiner*—Dana Ross
*Assistant Examiner*—Debra M Sullivan
(74) *Attorney, Agent, or Firm*—Clark Hill PLC

(57) ABSTRACT

A crimper tool for closing a pipe support assembly having first and second locking members. The crimper tool includes a first member having a first handle and a first jaw with a first engagement surface for engaging the second locking member. The crimper tool also includes a second member pivotally coupled to the first member and having a second handle and second jaw with a second engagement surface for engaging the first locking member, an upper support surface for engaging an outside surface of the support assembly, a guide surface for engaging a second end of the support assembly, and a lower support surface for engaging an inside surface of the support assembly. Squeezing the first and second handles together pivots the first and second members thereby moving the first and second jaws toward one another and urging the first and second locking members together to lockingly engage.

5 Claims, 8 Drawing Sheets

CRIMPER DEVICE

BACKGROUND OF THE INVENTION

1. Field of the Invention

The invention relates to a crimper device, and more particularly to a hand-held crimper device used to close a pipe support assembly having an integrated closure mechanism.

2. Description of the Related Art

Conventional pipes are used to convey or transfer fluids or gases in various industrial applications, such as sprinkler systems, refrigeration systems, and heating and cooling systems. These pipes are commonly encased in cellular foam pipe insulation tubing, which maintains the fluids or gases within the pipes at a desired temperature. The insulation tubing is typically provided in predetermined lengths that are aligned end-to-end to cover an entire length of the pipe. It is desirable to interconnect adjacent ends of the insulation tubing along the pipe to increase the insulation characteristics and efficiency of the pipe.

U.S. patent application Ser. No. 11/654,958 to Opperthauser discloses a pipe support assembly for securing a pipe to a generally planar supporting structure, such as a floor, ceiling, wall or other similar surface and retaining adjacent ends of pipe insulation tubing surrounding the pipe to ensure that the pipe remains insulated even as the pipe is exposed to wear and tear. More specifically, the pipe support assembly includes a cylindrical body having first and second body portions which flexibly pivot between an open position to receive the pipe and insulation tubing therein and a closed position surrounding the pipe and coupling the adjacent ends of the insulation tubing. The pipe support assembly also includes an integrated mounting clamp that allows for easily securing the pipe support assembly to a length of channel-section track that is mounted to the planar supporting structure. The pipe support assembly further includes an integrated closure mechanism or releasable clamp for securing the first and second body portions together in the closed position to retain the pipe therein and maintain the adjacent ends of the insulation tubing in an end-to-end relationship along the pipe.

Oftentimes, during installation, the pipe with the insulation tubing wrapped therearound must be installed into the pipe support assembly while an installer is standing on a ladder holding the insulated pipe to be supported. The installer must hold the insulated pipe in one hand while manipulating the first and second body portions of the cylindrical body with the other hand until the closure mechanism is engaged, securing the first and second body portions together. Moving the first and second body portions into the closed position to engage the closure mechanism using only one hand can prove very difficult at times. It is therefore desirable to provide a hand-held crimper tool which can be manually operated with one hand and is used to move the first and second body portions into the closed position around the pipe and insulation tubing, thereby engaging the closure mechanism.

SUMMARY OF THE INVENTION

According to one aspect of the invention, a crimper device is provided for closing a pipe support assembly. The crimper tool includes a first elongated member having a first handle and a first jaw, remote from the first handle. The first jaw includes a first engagement surface that engages an outer surface of a second locking member of the pipe support assembly. The crimper tool also includes a second elongated member pivotally coupled to the first elongated member and having a second handle and a second jaw, remote from the second handle. The second jaw includes a second engagement surface opposing the first engagement surface that engages an outer surface of a first locking member of the pipe support assembly, an upper support surface that engages an outside surface of a cylindrical body of the pipe support assembly adjacent the first locking member, a guide surface that engages a second end of the cylindrical body to laterally align the crimper tool with the first and second locking members, and a lower support surface opposing the upper support surface that engages an inside surface of the cylindrical body adjacent the first locking member. Squeezing the first and second handles together causes the first and second elongated members to pivot and thereby moves the first and second jaws toward one another and urges the first and second locking members together to lockingly engage.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
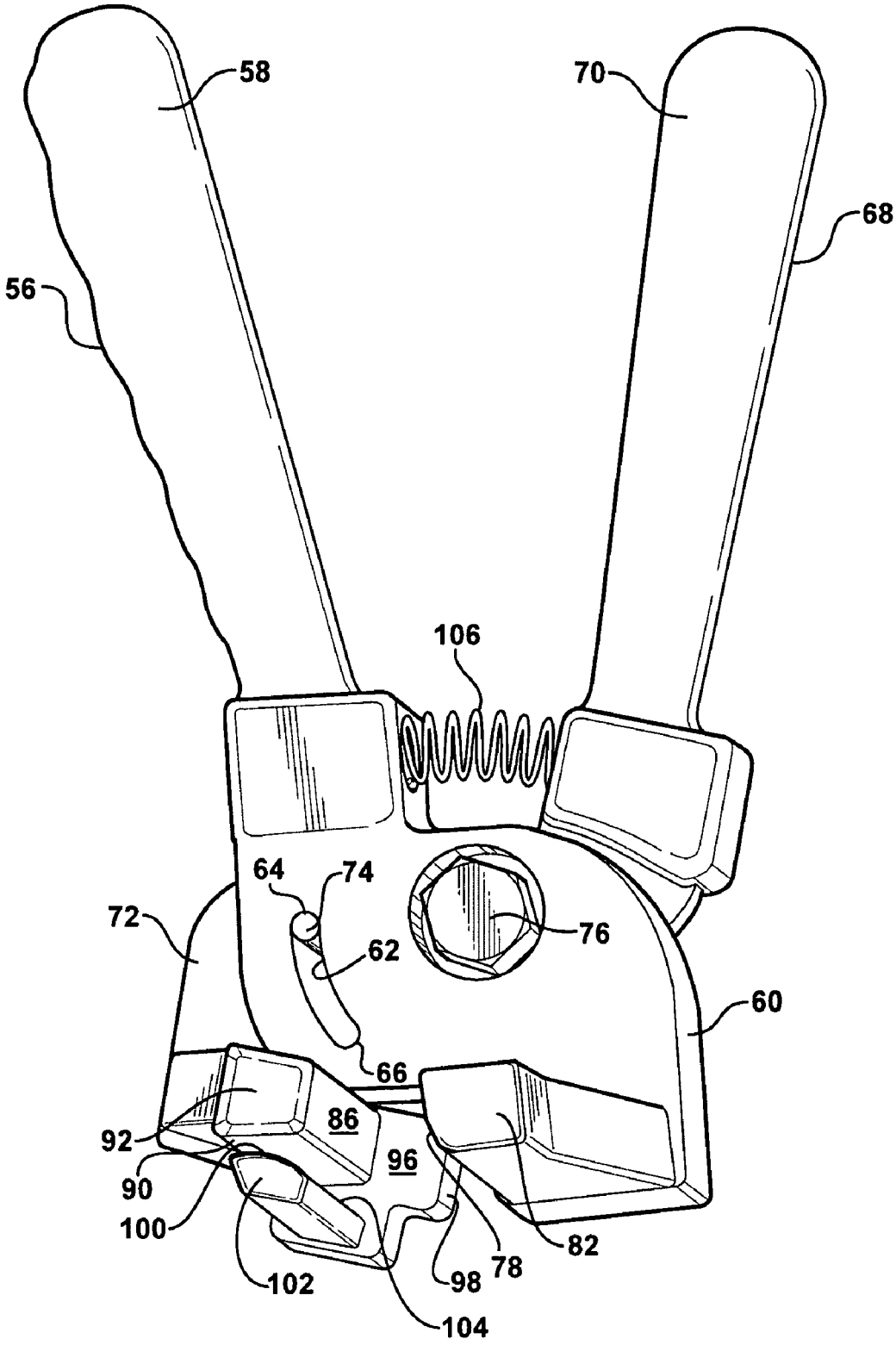
FIG. 1 is a perspective view of a hand-held crimper tool according to the invention.

Referring to the FIGS. 1, 2, and 6 through 8, a hand-held crimper tool, generally shown at 10, is provided for closing a pipe support assembly, generally shown at 12, around a length of pipe 14 and ends 16, 18 of pipe insulation tubing 20 surrounding the pipe 14. The pipe 14 is cylindrical, hollow and commonly formed of aluminum or copper and is utilized for transferring fluids or gases such as hydraulic pipes, pneumatic tubes, refrigeration lines, water pipes, and the like, as are typically known in the art. The insulation tubing 20, which is commonly formed from cellular polyurethane foam, is provided in predetermined lengths, and includes a longitudinal open slit 22 extending therealong that allows the insulation tubing 20 to be wrapped around the pipe 14.

Figure 2:
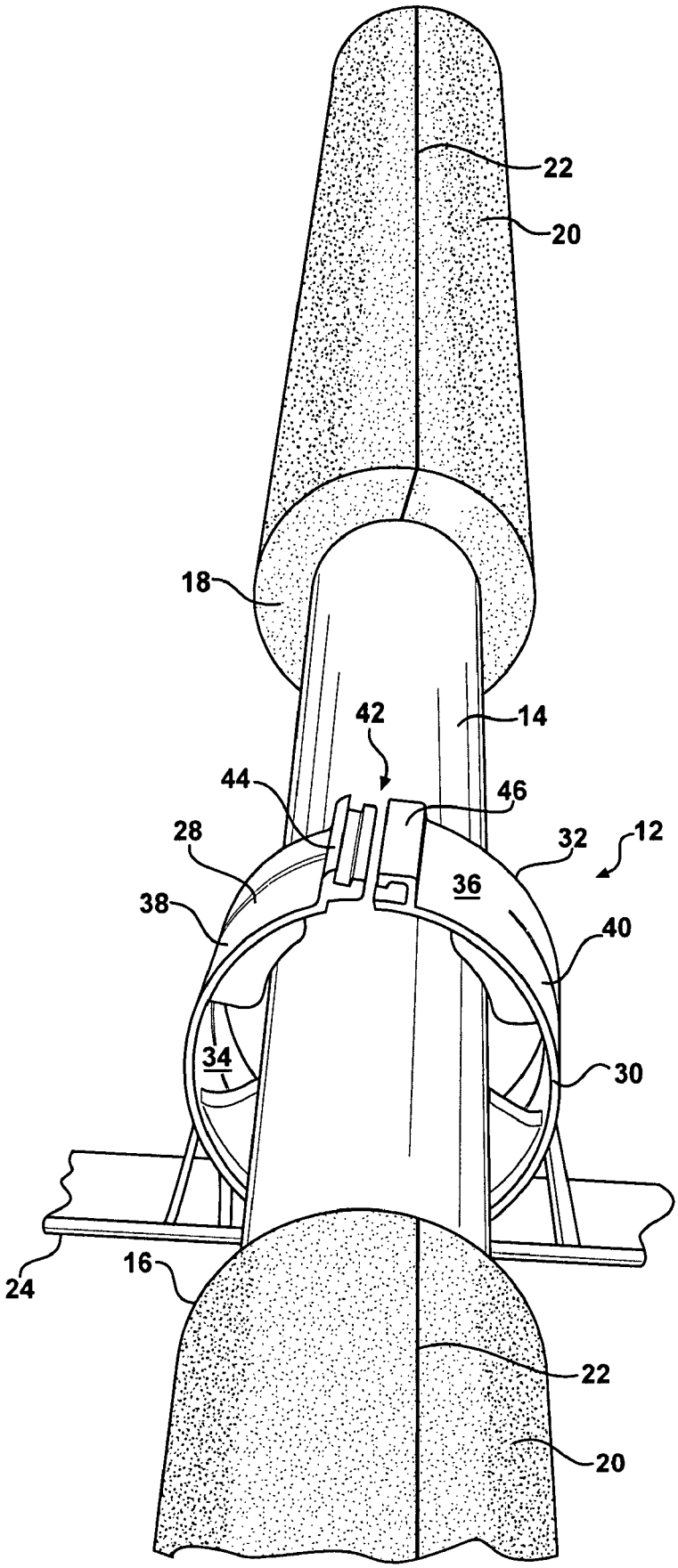
FIG. 2 is a perspective view of a pipe support assembly in an open position with a pipe extending therethrough.
Figure 3:
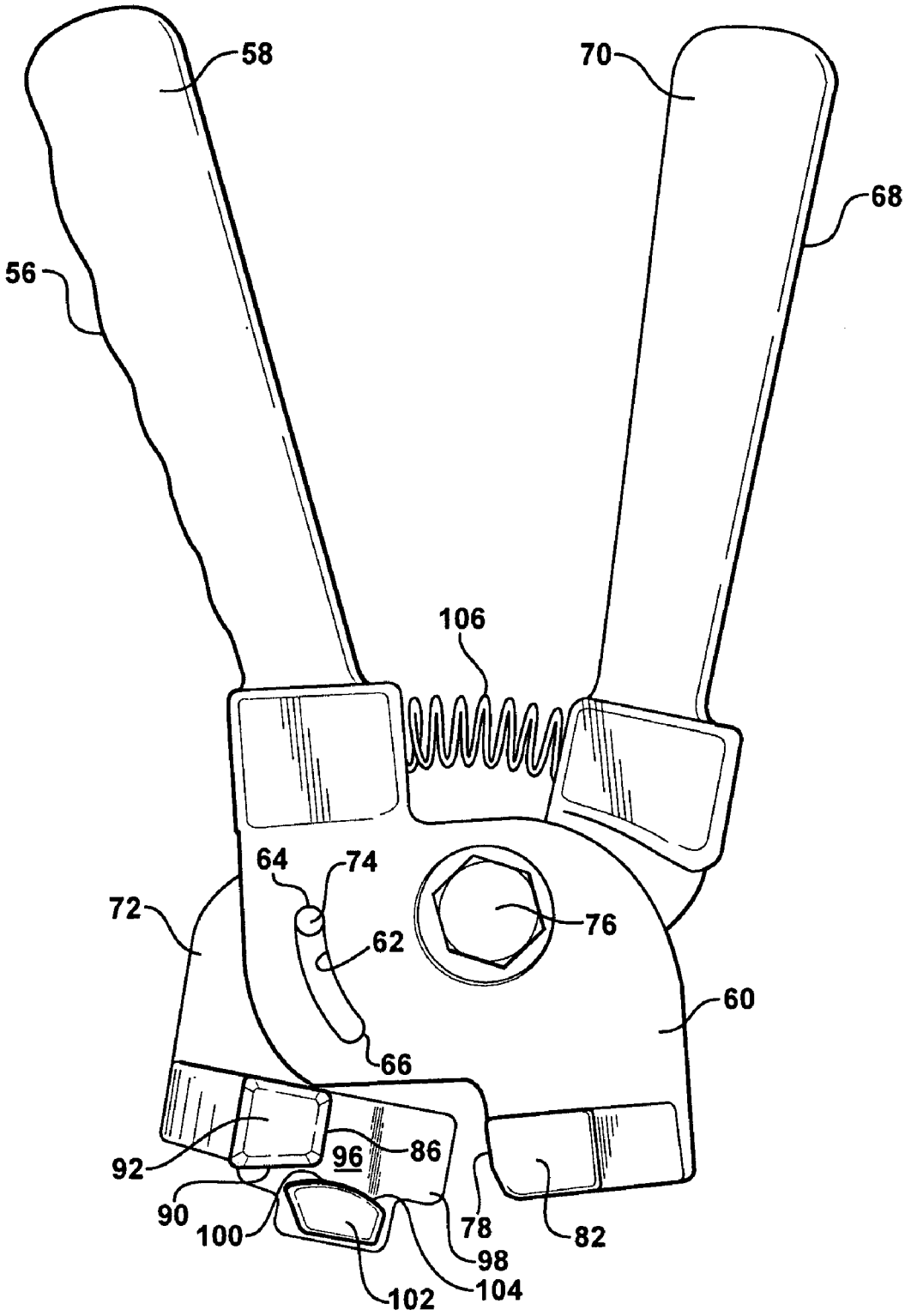
FIG. 3 is a front side view of the crimper tool.
Figure 4:
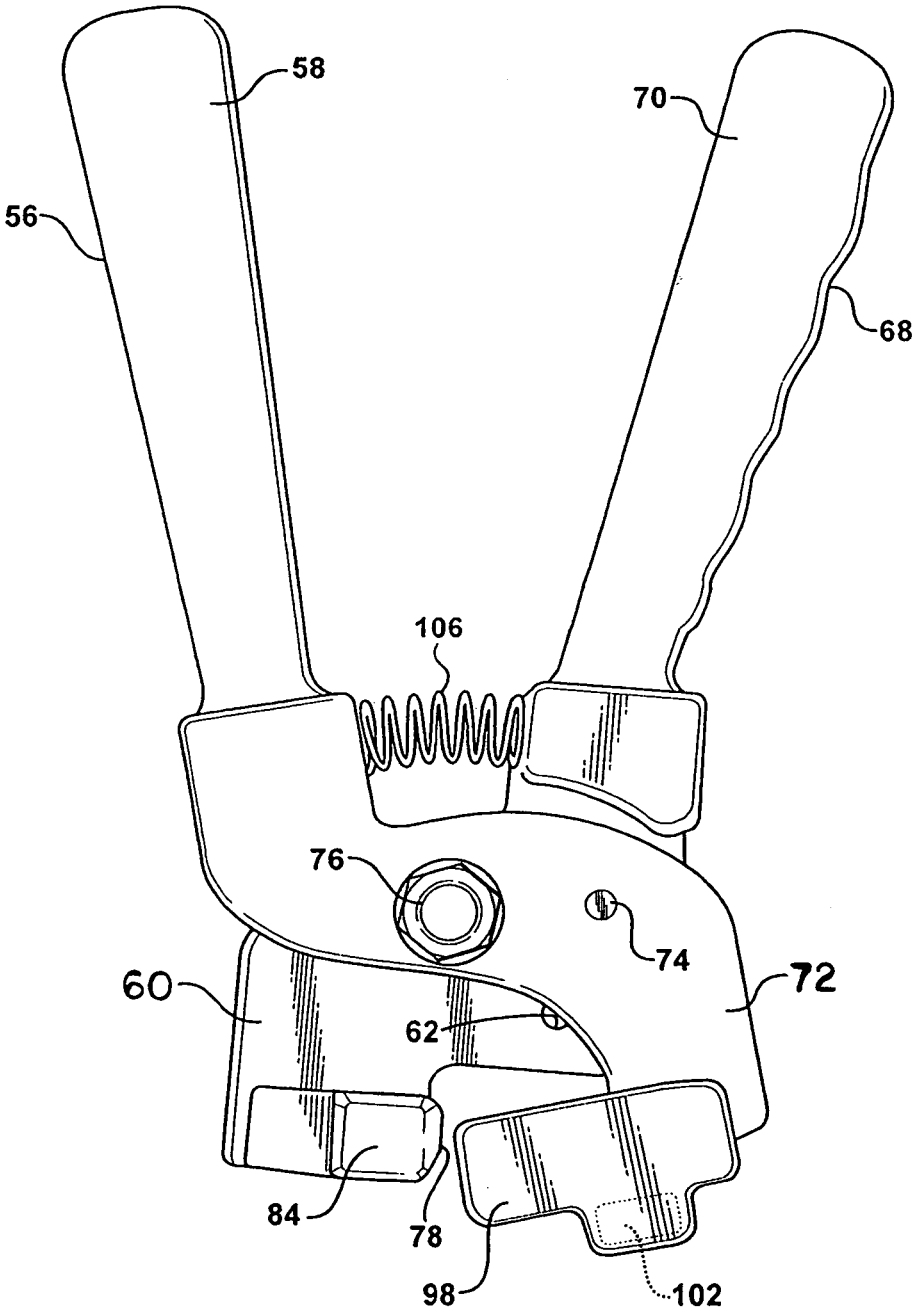
FIG. 4 is a back side view of the crimper tool.
Figure 5:
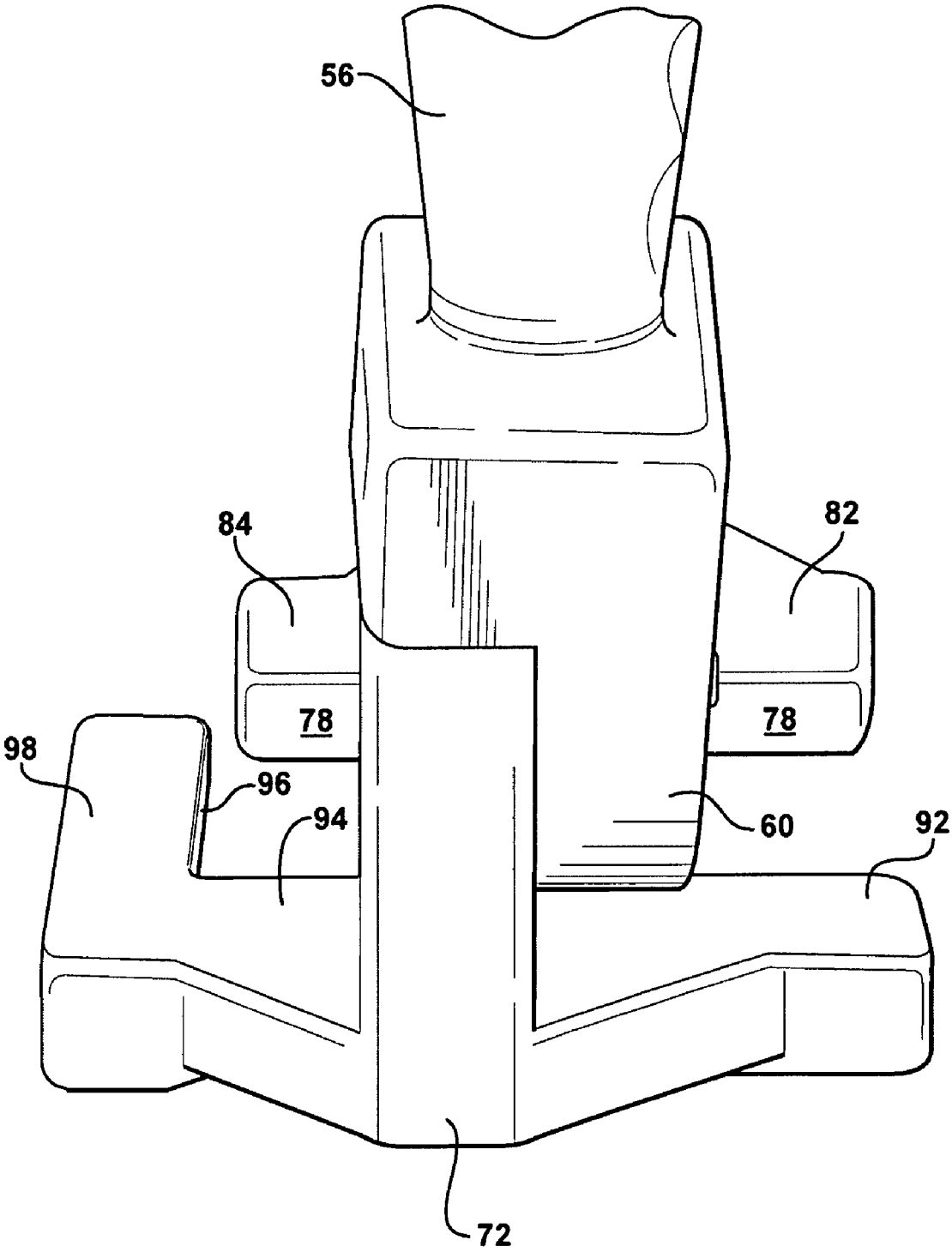
FIG. 5 is a fragmentary, end view of the crimper tool.

The pipe support assembly 12, shown in FIG. 2, is described in U.S. patent application Ser. No. 11/654,958 to Opperthauser, which is hereby expressly incorporated herein by reference in its entirety. The pipe support assembly 12 supports the pipe 14 and retains the insulation tubing 20 encased around the pipe 14. More specifically, the pipe support assembly 12 retains the ends 16, 18 of two separate portions of the insulation tubing 20 adjacent one another to ensure that an entire length of the pipe 14 remains insulated even as the pipe 14 is exposed to wear and tear. The pipe support assembly 12 is mounted to a length of channel-section track 24 which is secured to a generally planar supporting structure, such as a floor, ceiling, wall or similar surface.

Figure 8:
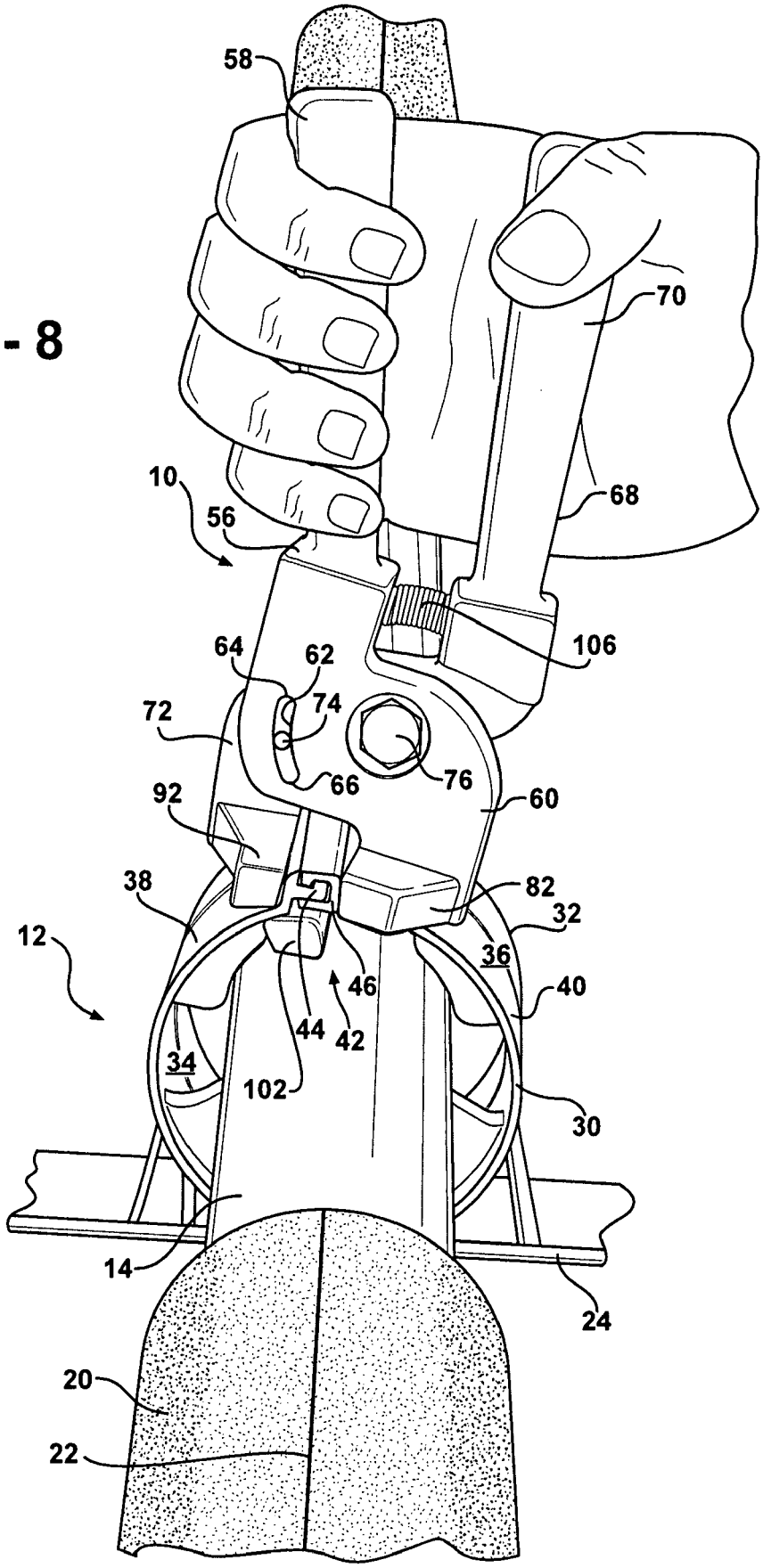
FIG. 8 is a perspective view of the crimper tool operatively engaging the pipe support assembly in a closed position.

The pipe support assembly 12 is constructed of a one-piece, integrally molded plastic and includes an elongated cylindrical body 28 extending longitudinally between a first end 30 and a second end 32. The cylindrical body 28 also includes an inside surface 34 and an outside surface 36. The cylindrical body 28 is split longitudinally from the first end 30 to the second end 32 to define a first body portion 38 and a second body portion 40. The first 38 and second 40 body portions flexibly pivot between an open position to receive the pipe 14, as shown in FIG. 2, and a closed position surrounding the pipe 14 and coupling the ends 16, 18 of the insulation tubing 20, as shown in FIG. 8.

Figure 7:
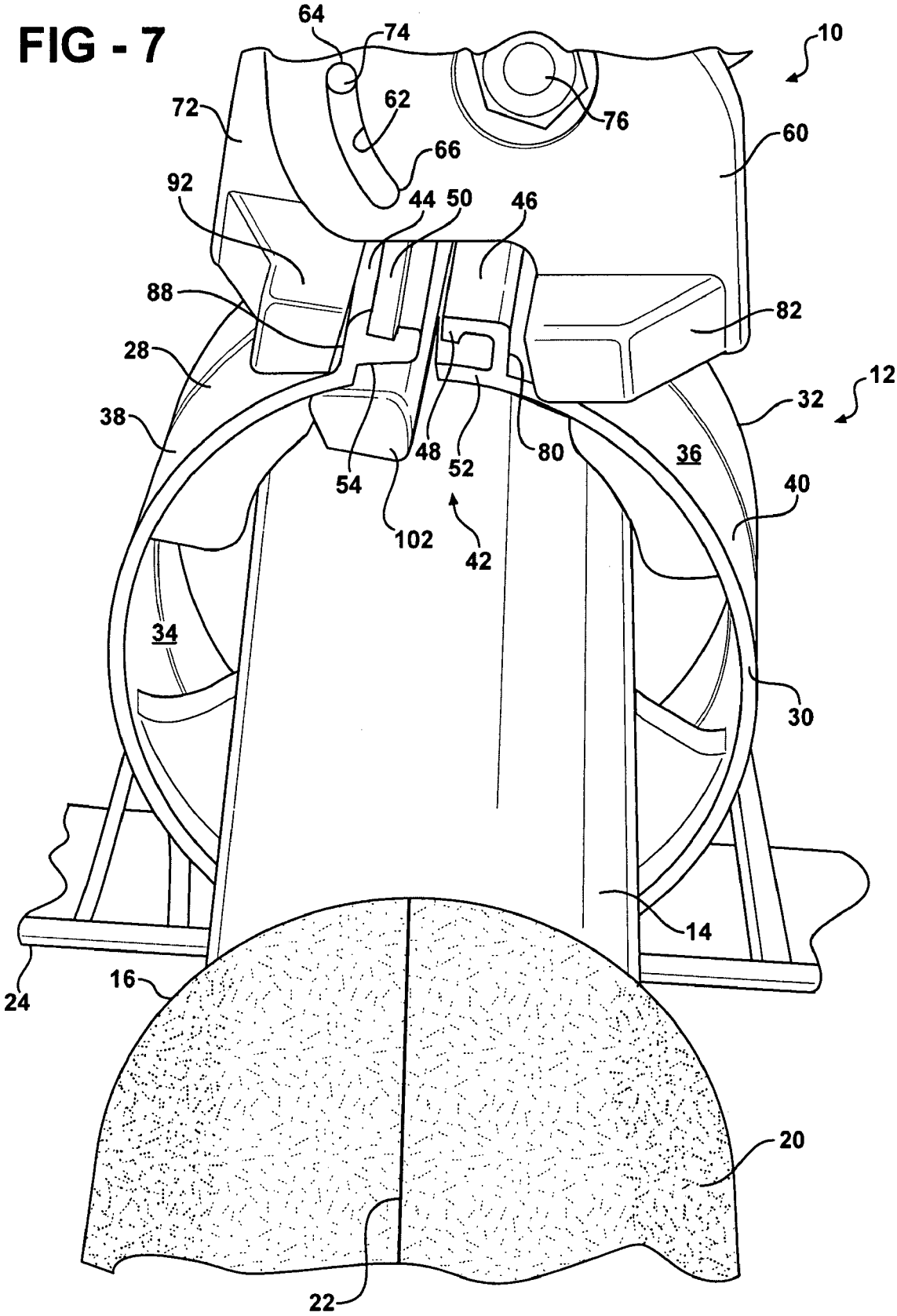
FIG. 7 is an enlarged view of the crimper tool operatively engaging the pipe support assembly of FIG. 6.

Referring to FIGS. 2 and 7, the pipe support assembly 12 also includes an integrated closure mechanism or releasable clamp, generally shown at 42, for securing the first 38 and second 40 body portions together. The clamp 42 extends longitudinally along the split in the cylindrical body 28 between the first 30 and second 32 ends. The clamp 42 includes a male member 44 integrally formed on the first body portion 38 and a female member 46 integrally formed on the second body portion 40. The female member 46 is shaped complementarily with respect to the male member 44. More specifically, a shoulder 48 protruding from the female member 46 lockingly engages a notch 50 formed in the male member 44 when the first 38 and second 40 body portions are brought into the closed position. In addition, the female member 46 defines a tongue 52 extending circumferentially with the cylindrical body 28. The male member 44 defines a recessed step 54 for receiving the tongue 52. When the first 38 and second 40 body portions are in the closed position, the tongue 52 is disposed in the recessed step 54 and completes the inside surface 34 of the cylindrical body 28.

An installer can manipulate the first 38 and second 40 body portions into the closed position by urging the first 38 and second 40 body portions together until the male 44 and female 46 members are lockingly engaged. At times, this may be prove difficult for the installer if only one hand is available or after closing a large number of pipe support assemblies 12. Thus, the crimper tool 10 is provided to make closing the pipe support assembly 12 easier for the installer. Hand fatigue is eliminated because the crimper tool 10 decreases the amount of effort required to lockingly engage the male 44 and female 46 members by using the mechanical advantage of the crimper tool, as is further described below. In addition, the crimper tool 10 ensures that the male 44 and female 46 members lockingly engage along the entire length of the clamp 42 between the first 30 and second 32 ends of the cylindrical body 28 to produce a complete and correct seal.

Referring to FIGS. 1, and 3 through 8, the crimper tool 10 includes a first elongated member 56 having a first handle 58 and a first jaw 60 disposed remote from the first handle 58. The first member 56 also includes an arcuate slot 62 that is disposed between the first handle 58 and the first jaw 60. The slot 62 extends between a first end 64 and a second end 66. The crimper tool 10 also includes a second elongated member 68 having a second handle 70 and a second jaw 72 disposed remote from the second handle 70. The second member 68 also includes a pin 74 extending laterally therefrom that is disposed between the second handle 70 and the second jaw 72. The pin 74 is slidably disposed in the slot 62 in the first member 56. The first 56 and second 68 members are pivotally coupled at a scissor pivot 76 such that moving the first 58 and second 70 handles closer together also moves the first 60 and second 72 jaws closer together. Alternatively, moving the first 58 and second 70 handles farther apart also moves the first 60 and second 72 jaws farther apart. It is appreciated that the position of the pivot 76 multiples the force put into the first 58 and second 70 handles to provide a mechanical advantage to the first 60 and second 72 jaws.

The first jaw 60 includes a first engagement surface 78 for engaging an outer surface 80 of the female member 46 of the clamp 42, best seen in FIG. 7. The first engagement surface 78 is defined by a first pair of projections 82, 84 extending laterally in opposite directions from each side of the first jaw 60.

The second jaw 72 includes a second engagement surface 86, opposing the first engagement surface 78, for engaging an outer surface 88 of the male member 44 of the clamp 42, best seen in FIG. 7. The second jaw 72 also includes an upper support surface 90 for engaging the outside surface 36 of the cylindrical body 28, adjacent the male member 44. The second engagement surface 86 and the upper support surface 90 are defined by a second pair of projections 92, 94 extending laterally in opposite directions from each side of the second jaw 72. The second jaw 72 further includes a guide surface 96 for engaging the second end 32 of the cylindrical body 28 in order to laterally align the crimper tool 10 with the clamp 42. The guide surface 96 is defined by a transverse projection 98 extending perpendicular from a distal end of the projection 94. The second jaw 72 further includes a lower support surface 100 for engaging the inside surface 34 of the cylindrical body 28, adjacent the male member 44. The lower support surface 100 is defined by a secondary projection 102 extending from the transverse projection 98 that is parallel to and spaced apart from the second pair of projections 92, 94. The secondary projection 102 includes a leading edge surface 104 for guiding the tongue 52 of the female member 46 into the recessed step 54 of the male member 44 as the first 38 and second 40 body portions move toward the closed position.

Alternatively, it is contemplated that the crimper tool 10 can be oriented relative to the pipe support assembly 12 such that the first engagement surface 78 will engage the outer surface 88 of the member 44 and the second engagement surface 86 will engage the outer surface 80 of the female member 46 without varying from the scope of the invention. In this orientation, the guide surface 96 engages the first end 30 of the cylindrical body 28 in order to laterally align the crimper tool 10 with the clamp 42.

A spring 106 extends between the first 58 and second 70 handles near the scissor pivot 76. The spring 106 urges the first 60 and second 72 jaws into a ready position, wherein the first 78 and second 86 engagement surfaces are spaced from one another. In the ready position, the pin 74 is disposed at the first end 64 of the slot 62. Squeezing the first 58 and second 70 handles together pivots the first 56 and second 68 members about the scissor pivot 76 such that the first 60 and second 72 jaws are in an actuated position, wherein the first 78 and second 86 engagement surfaces are adjacent one another. In the actuated position, the pin 74 is disposed near the second end 66 of the slot 62. The pin 74 and the slot 62 provide guidance for the first 56 and second 68 members as the first 60 and second 72 jaws move between the ready and actuated positions.

Figure 6:
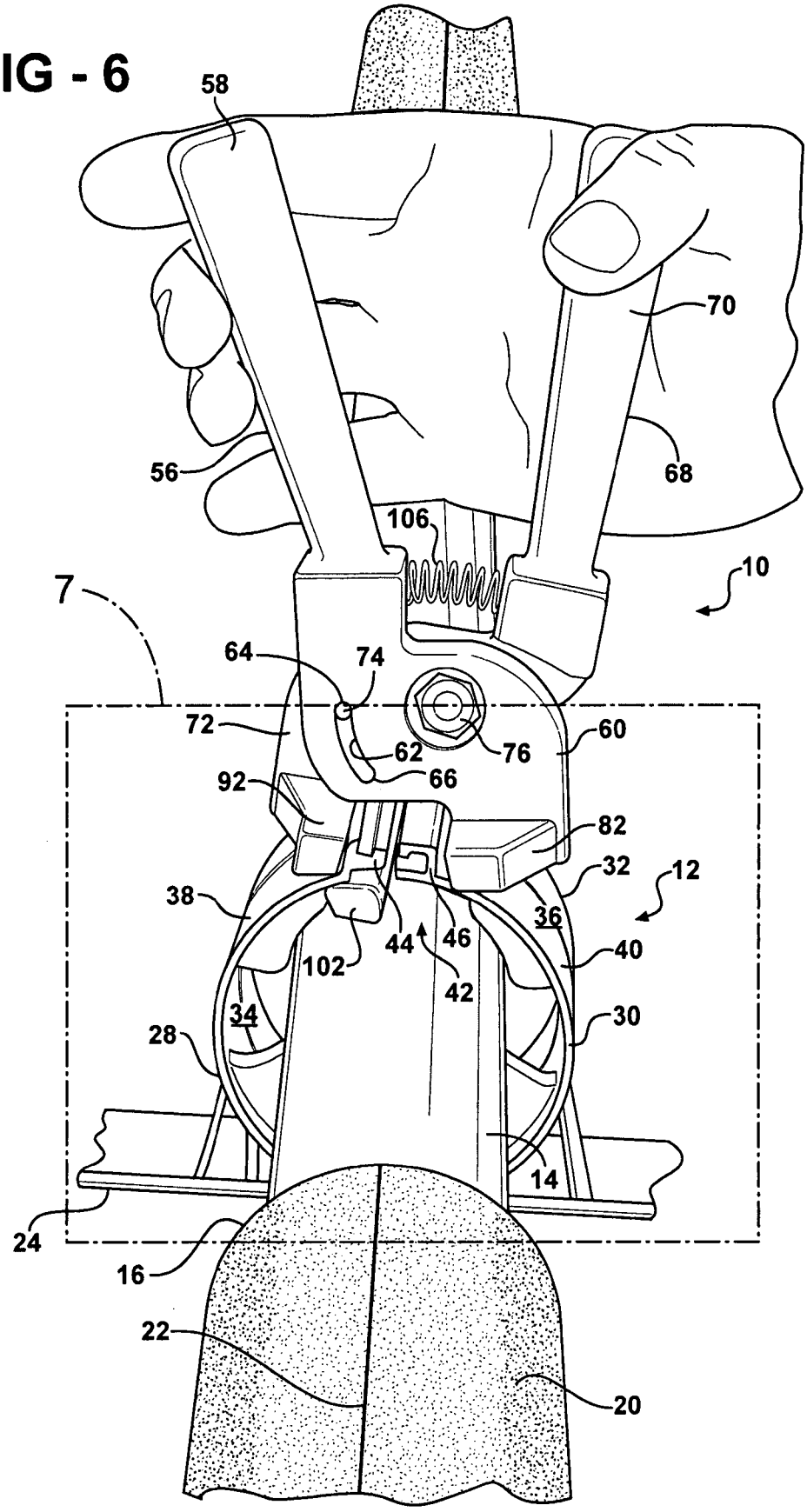
FIG. 6 is a perspective view of the crimper tool operatively engaging the pipe support assembly in the open position.

The crimper tool 10 is used to close the pipe support assembly 12 around the pipe 14 as follows. The spring 106 normally holds the first 60 and second 72 jaws in the ready position. With the first 60 and second 72 jaws in the ready position, the unlocked clamp 42 of the pipe support assembly 12 is placed between the first 60 and second 72 jaws, as shown in FIGS. 6 and 7. More specifically, an open end of the second jaw 72 is slid onto the first body portion 38 of the cylindrical body 28 until the guide surface 96 is engaging the second end 32 of the cylindrical body 28. In this position, the male member 44 of the first body portion 38 is positioned between the second pair of projections 92, 94 and the secondary projection 102 of the second jaw 72 such that the second engagement surface 86 is engaging the outer surface 88 of the male member 44, the upper support surface 90 is engaging the outside surface 36 of the cylindrical body 28, and the lower support surface 100 is engaging the inside surface 34 of the cylindrical body 28. At the same time, the female member 46 of the second body portion 40 is positioned adjacent the first pair of projections 82, 84 of the first jaw 60 such that the first engagement surface 78 is engaging the outer surface 80 of the female member 46. As the first 58 and second 70 handles are squeezed together, the first 60 and second 72 jaws move toward the actuated position and the first 78 and second 86 engagement surfaces urge the female 46 and male 44 members toward one another. Eventually, the tongue 52 of the female member 46 engages the leading edge surface 104 of the secondary projection 102 thereby guiding the tongue 52 into the recessed step 54 of the male member 44. The first 58 and second 70 handles are squeezed until the male 44 and female 46 members lockingly engage and the first 38 and second 40 body portions of the cylindrical body 28 are in the closed position, as shown in FIG. 8. The crimper tool 10 is then removed from the pipe support assembly 12. Once the first 38 and second 40 body portions of the cylindrical body 28 are in the closed position, each piece of the insulation tubing 20 is slid along the pipe 14 toward the pipe support assembly 12 until the ends 16, 18 are adjacent one another.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed is:

1. A crimper tool for closing a pipe support assembly including an elongated cylindrical body extending longitudinally between first and second ends and having an inside surface and an outside surface, the cylindrical body split longitudinally to define a first body portion having a first locking member and a second body portion having a second locking member, the first locking member lockingly engageable with the second locking member and including an outer surface and a stepped recess, and the second locking member including an outer surface and a tongue for engaging the stepped recess, said crimper tool comprising:

a first elongated member including a first handle and a first jaw remote from said first handle, said first jaw including a first engagement surface for engaging the outer surface of the second locking member; and a second elongated member pivotally coupled to said first elongated member and including a second handle and a second jaw remote from said second handle, said second jaw including a second engagement surface opposing said first engagement surface for engaging the outer surface of the first locking member, an upper support surface for engaging the outside surface of the cylindrical body adjacent the first locking member, a guide surface for engaging the second end of the cylindrical body to laterally align said crimper tool with the first and second locking members, and a lower support surface opposing said upper support surface for engaging the inside surface of the cylindrical body adjacent the first locking member;

whereby squeezing said first and second handles together pivots said first and second elongated members thereby moving said first and second jaws toward one another and urging the first and second locking members together to lockingly engage.

2. A crimper tool as set forth in claim 1 wherein said first jaw includes a first pair of projections extending laterally in opposite directions to define said first engagement surface and said second jaw includes a second pair of projections extending laterally in opposite directions to define said second engagement surface and said upper support surface, a transverse projection extending perpendicularly from a distal end of one of said second pair of projections to define said guide surface, and a secondary projection extending from said transverse projection parallel to and spaced apart from said second pair of projections to define said lower support surface.

3. A crimper tool as set forth in claim 2 wherein said secondary projection includes a leading edge surface for guiding the tongue of the second locking member into the recessed step of the first locking member.

4. A crimper tool as set forth in claim 3 including a spring extending between said first and second handles thereby urging said first and second jaws into a ready position wherein said first engagement surface is spaced from said second engagement surface.

5. A crimper tool as set forth in claim 4 wherein said first elongated member includes an arcuate slot and said second elongated member includes a pin slidably disposed in said arcuate slot whereby said pin and said arcuate slot guide said first and second jaws between said ready position and an actuated position wherein said first engagement surface is adjacent said second engagement surface.

* * * * *